United States Patent [19]

Copeland

[11] 4,329,996

[45] May 18, 1982

[54] PROTECTIVE PACIFIER

[76] Inventor: Stephen A. Copeland, 1832 Alice Dr., Charleston, S.C. 29407

[21] Appl. No.: 143,349

[22] Filed: Jul. 28, 1980

[51] Int. Cl.[3] ..... A61J 17/00

[52] U.S. Cl. ..... 128/359; 128/360

[58] Field of Search ..... 128/359, 360, 252

[56] References Cited

U.S. PATENT DOCUMENTS

| | | | |
|---|---|---|---|
| D. 243,366 | 2/1927 | Lybe et al. | 128/360 |
| 1,095,264 | 5/1914 | Bridges | 128/360 |
| 1,701,566 | 2/1929 | Hevins | 128/252 |
| 2,347,150 | 4/1944 | Consolazio | 128/252 |
| 2,365,947 | 12/1944 | Ganson | 128/252 |
| 2,579,194 | 12/1951 | Kronish | 128/252 |
| 2,720,328 | 10/1955 | Clemens | 128/252 |
| 2,834,350 | 5/1958 | Beck, Jr. et al. | 128/360 |
| 3,022,915 | 2/1962 | Mullin | 128/360 |
| 3,286,864 | 11/1966 | Patterson | 128/252 |
| 3,363,630 | 1/1968 | Hines | 128/360 |
| 3,549,036 | 12/1970 | Ritsi | 128/252 |
| 3,651,973 | 3/1972 | Yamauchi | 128/252 |
| 3,677,429 | 7/1972 | La Barge | 128/252 |

*Primary Examiner*—V. Millin
*Assistant Examiner*—C. W. Shedd
*Attorney, Agent, or Firm*—Richards, Shefte & Pinckney

[57] ABSTRACT

A protective pacifier cap which keeps pacifier clean and germ free. This cap is attached to base of pacifier with therein connected by lining arrow on cap, to opening on pacifier. Line up, snap on, and twist to put together. Line up, pull apart to separate parts. There is a handle to pull apart and snap together. The cap extends to form a handle which may be gripped in a baby's hand. At the end of the cap handle is a hole for attachment to a roller-buggie. This cap is for keeping germs away from baby pacifiers.

2 Claims, 5 Drawing Figures

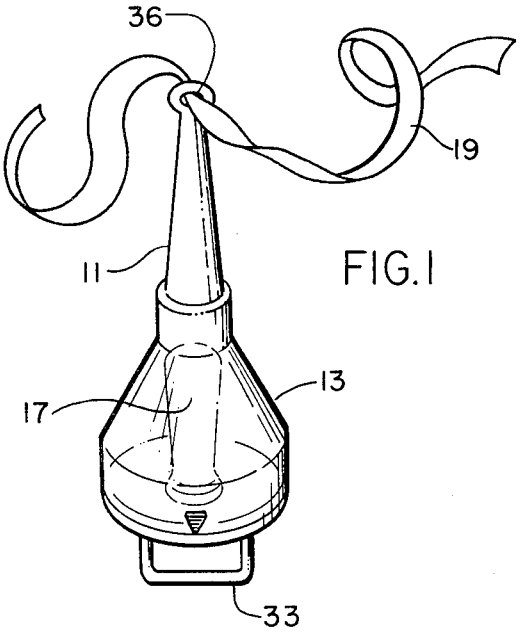
FIG. 1
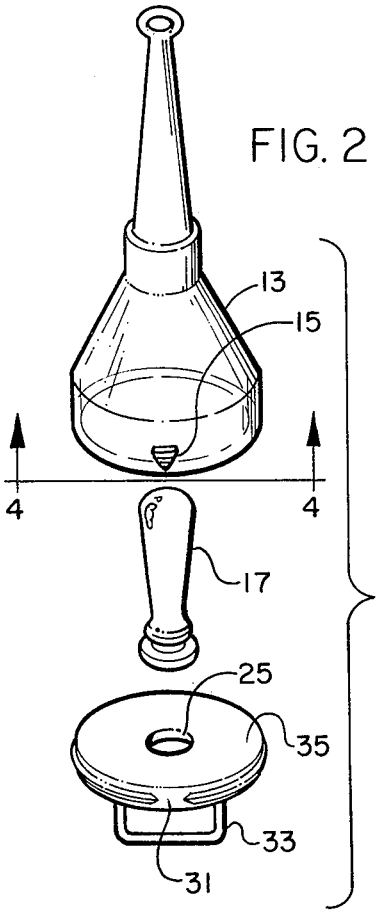
FIG. 2
FIG. 3
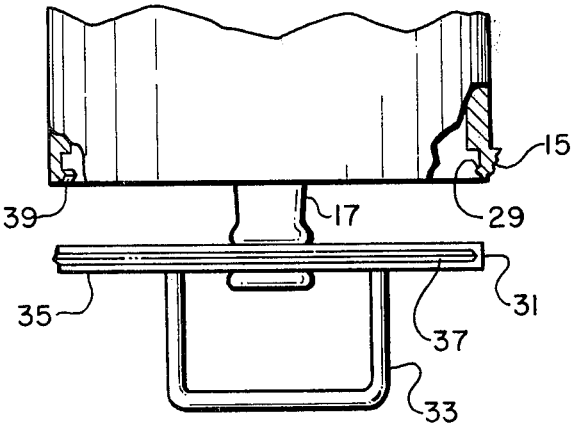
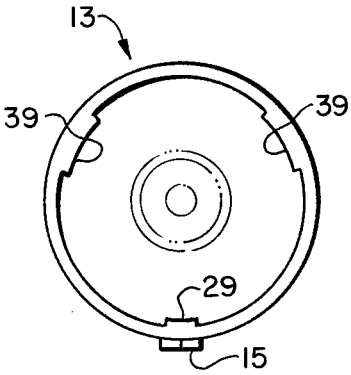
FIG. 4

PROTECTIVE PACIFIER

BACKGROUND OF THE INVENTION

This invention relates generally to a baby pacifier that is used with a cap to protect the pacifier when closed and also keeps the baby entertained when closed.

All other pacifiers are sold without this cap and this makes it hard to keep pacifier sanitary. The protective pacifier helps to prevent germs, is convenient for a mother to carry in her purse, and while closed, the pacifier keeps the baby entertained.

The pacifier cap is held on by a snap and twist. This way it cannot be pulled apart by baby, and still keeps nipple clean and sanitary.

This protective pacifier is reversible as shown in the drawings. It also has a hole at the end of the handle in case the mother or father wants to attach it to a roller-buggie.

The advantage that the protective pacifier has over other pacifiers is that it keeps the nipple of the pacifier clean and sanitary, which should appeal to many purchasers.

SUMMARY OF THE INVENTION

Accordingly, the present invention provides a reversible cap, which may be snapped on both sides of the pacifier. This cap is held together by a snap and a twist. There is an arrow on the cap and an opening on the pacifier. As shown in the drawings, the cap is lined up, arrow to opening, and attached and detached.

A handle is mounted on the bottom base of the pacifier with which to pull apart pacifier from cap. The base of the pacifier has a diameter of 2 inches. The nipple extends within or without the cap by 1 inch. With this sanitary pacifier, germ problems are substantially reduced.

BRIEF DESCRIPTION OF THE DRAWING

The objects and advantages of this invention will become obvious from the following description taken in conjunction with the drawings wherein:

FIG. 1 is a perspective view of a pacifier with a cap in accordance with the present invention here shown with ribbon through the end of the handle;

FIG. 2 is an exploded view showing the relationship between the base, the nipple and the cap;

FIG. 3 is a sectional view taken at the side of the cap and pacifier.

FIG. 4 is a bottom view of the cap as indicated in FIG. 2.

DETAILED DESCRIPTION OF A PREFERRED EMBODIMENT OF THE INVENTION

Figure 5:
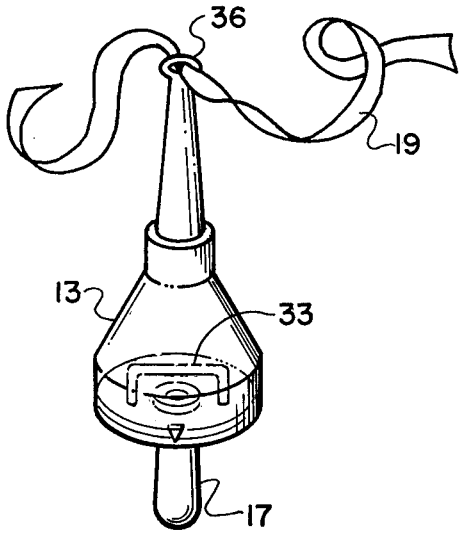
FIG. 5 is a perspective view to FIG. 1 with the nipple reversed.

FIG. 1 discloses the primary use of the present invention wherein the assembled baby protective pacifier comprising a rubber nipple 17, the cap 13, the handle 33. The grip handle 11 serves a purpose so that a baby can hold on to and play with the present invention like a rattler. The pacifier cap is shown with a ribbon 19 through an end hole 36. It is quite obvious that this pacifier cap is more convenient for mothers and provides better entertainment for a baby.

FIG. 2 is an exploded view showing the nipple 17, the relationship between the cap 13, and the plastic base 35.

FIG. 3 shows how nipple 17 goes through base hole 25. The arrow 15 is lined up with the opening 31 so that cap 13 can be snapped on and then twisted to secure same. Then to detach the two parts, align arrow 15 with opening 31 and pull apart by handle 33 and grip 11.

After use of pacifier, just reverse cap 13 over nipple 17 and line up arrow 15 to opening 31 and then snap and twist. It keeps germs off nipple 17 and is very convenient for a mother to have.

FIG. 3 is a sectional view showing how arrow 15 and opening 31 work in order to cover nipple 17. Around the base 35 is a plastic ring 37 which goes substantially all the way around base 35, but does not connect. It has an opening so that a protuberance on the back of arrow 15 can go through. Within cap 13, behind arrow 15 is a lip of plastic 29 that fits between the ends of plastic ring 37 so as to keep cap 13 from coming off after twisting. This lip 29 is made so that cap 13 may be attached to base 35 from either side.

FIG. 4 is a bottom view of the cap 13 showing projections 39 extending inwardly and the lip 29. The projections 39 and the lip 29 hold the ring 37 when the base 35 is inserted in the cap 13 in either position.

FIG. 5 illustrates the protective pacifier at its disposition for use by a baby, with the nipple 17 extending outwardly of the cap 13 and with the handle 33 disposed within the cap 13.

I claim:

1. A selectively reversible and sanitary pacifier which comprises a base member having a solid resilient nipple attached thereto and extending outwardly from one side thereof, and having handle means extending outwardly from the other side thereof, a cap member formed with a hollow portion slightly larger than said nipple and having a configuration for selectively receiving and covering said solid resilient nipple, and means formed on said cap member and said base member for selectively and alternatively attaching said base member to said cap member at a first dispostion at which said resilient nipple extends into and is covered by said cap member with said handle means being exposed and at a second disposition at which said resilient nipple extends outwardly away from said cap member in an exposed manner for use, said attaching means including cooperating projection means arranged on said cap member and said base member to engage one another and hold the cap member and base member together at all relative positions thereof except one predetermined relative position at which said projection means may be disengaged to permit separation of said base member and said cap member.

2. A selectively reversible and sanitary pacifier as defined in claim 1 and further characterized in that said base element is circular in shape, in that said cap member has a circular opening corresponding in size to said base element, and in that said attaching means includes an annular projection extending around the periphery of said base element with an opening between the ends of said annular projection, and includes protuberances extending inwardly of said circular opening in said cap member for selectively engaging said annular projection, at least one of said protuberances being smaller than said opening in said opening in said annular projection to permit selective disengagement of said cap member and said base member when said one protuberance and said opening in said annular projection are aligned.

* * * * *